United States Patent [19]

Stoler

[11] Patent Number: 4,730,809

[45] Date of Patent: Mar. 15, 1988

[54] TAUT WIRE FENCE SYSTEM

[75] Inventor: Arie Stoler, Holon, Israel

[73] Assignee: Israel Aircraft Industries Ltd., Israel

[21] Appl. No.: 661,912

[22] Filed: Oct. 17, 1984

[30] Foreign Application Priority Data

Oct. 30, 1983 [IL] Israel ..... 70087

[51] Int. Cl.[4] ..... E04H 17/00

[52] U.S. Cl. ..... 256/1; 256/10; 200/61.93; 340/668

[58] Field of Search ..... 256/1, 10; 200/61.93; 340/668, 548, 541

[56] References Cited

U.S. PATENT DOCUMENTS

| | | | |
|---|---|---|---|
| 385,095 | 6/1888 | Cockrell | 256/10 X |
| 709,617 | 9/1902 | Utter | 256/55 |
| 756,749 | 4/1904 | Watts | 256/56 |
| 1,031,535 | 7/1912 | Di Giovanni | 340/550 |
| 1,483,005 | 2/1924 | McNair | 256/10 |
| 2,075,147 | 3/1937 | Stotts | 200/61.93 |
| 2,086,405 | 7/1937 | Darden | 200/61.93 |
| 2,350,290 | 5/1944 | Moore | 200/61.93 X |
| 2,633,337 | 3/1953 | Nieuwenhuis | 256/10 |
| 3,495,054 | 2/1970 | Lea | 200/61.93 |
| 3,634,638 | 1/1972 | Even-Tov | 200/61.93 |
| 4,005,397 | 1/1977 | Blair | 256/1 X |
| 4,367,459 | 1/1983 | Amir | 200/61.93 X |
| 4,533,906 | 8/1985 | Amir | 200/61.93 X |

FOREIGN PATENT DOCUMENTS

| | | | |
|---|---|---|---|
| 41794 | 12/1981 | European Pat. Off. . | |
| 367270 | 1/1923 | Fed. Rep. of Germany | 200/61.93 |
| 415355 | 7/1910 | France | 340/550 |
| 60240 | 7/1982 | Israel . | |
| 29673 | 10/1910 | Sweden | 200/61.93 |
| 6473 | of 1886 | United Kingdom . | |
| 350519 | 6/1931 | United Kingdom . | |
| 356744 | 9/1931 | United Kingdom . | |
| 845382 | 8/1960 | United Kingdom . | |
| 1344062 | 1/1974 | United Kingdom . | |
| 1395151 | 5/1975 | United Kingdom . | |
| 2009880 | 6/1979 | United Kingdom . | |
| 2019097 | 10/1979 | United Kingdom . | |
| 2041609 | 7/1980 | United Kingdom | 256/10 |
| 2060966 | 5/1981 | United Kingdom . | |
| 2105505 | 3/1983 | United Kingdom . | |

*Primary Examiner*—Andrew V. Kundrat

*Attorney, Agent, or Firm*—Poms, Smith, Lande & Rose

[57] ABSTRACT

A taut wire fence system comprising a plurality of lenghts of taut wire strung in generally parallel orientation and mounted between a pair of anchoring posts and a sensor post, and characterized in that at least two of the plurality of lengths are interconnected whereby a change in tension on one of the lengths causes a change in tension on another one of the lengths interconnected therewith.

9 Claims, 4 Drawing Figures

TAUT WIRE FENCE SYSTEM

FIELD OF THE INVENTION

The present invention relates to protective fences generally and more particularly to taut-wire protective fences.

BACKGROUND OF THE INVENTION

Various types of taut-wire protective fences are known in the patent literature and in the marketplace. Simply described, taut wire protective fences incorporate tensioned wires which are connected to sensors. These sensors provide an alarm indication of an attempt to climb or cut the fence. U.S. Pat. Nos. 3,634,638 and 3,912,893, owned by applicants, describe sensors which are paticuarly suited for taut wire fence applications and which have found wide market acceptance.

Applicant has, in the past, constructed taut wire fence installations wherein a plurality of wires are connected to a common terminal of a single sensor. Such an arrangement is also shown in later filed and published Israel Patent Application No. 60240, wherein a common member is used to attach a plurality of taut wires to a common terminal of a sensor.

In copending Israel Patent Application No. 69945, filed Oct. 10, 1983, applicant discloses and claims a taut wire fence system and sensor therefor, wherein the sensor comprises first and second taut wire connection terminals arranged for relative motion and first and second electrical contacts, each associated with a respective one of the first and second connection terminals and arranged such that a predetermined relative motion btween the first and second connection terminals produces an electrical connection between the first and second electrical contacts.

It may be appreciated that the system of Israel Patent Application No. 69945 is highly sensitive to the disturbance of two adjacent taut wires.

There exists, however, a universal concern that taut wire fence systems, even of the types described above, might be susceptible to neutralization by simultaneous clamping of the wires thereof to fixed locations on either side of a sensor.

SUMMARY OF THE INVENTION

The present invention seeks to provide a taut wire fence system which is highly resistant to neutralization by clamping.

There is thus provided in accordance with a preferred embodiment of the present invention, a taut wire fence system comprising a plurality of lengths of taut wire strung in generally parallel orientation and mounted between a pair of anchoring posts and a sensor post, and characterized in that at least two of the plurality of lengths are interconnected whereby a change in tension on one of the lengths causes a change in tension on another one of the lengths interconnected therewith.

In accordance with one preferred embodiment of the present invention, the interconnected lengths are adjacent. In accordance with another preferred embodiment of the invention, the interconnected lengths are non-adjacent. Two or more lengths may be interconnected, as desired.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
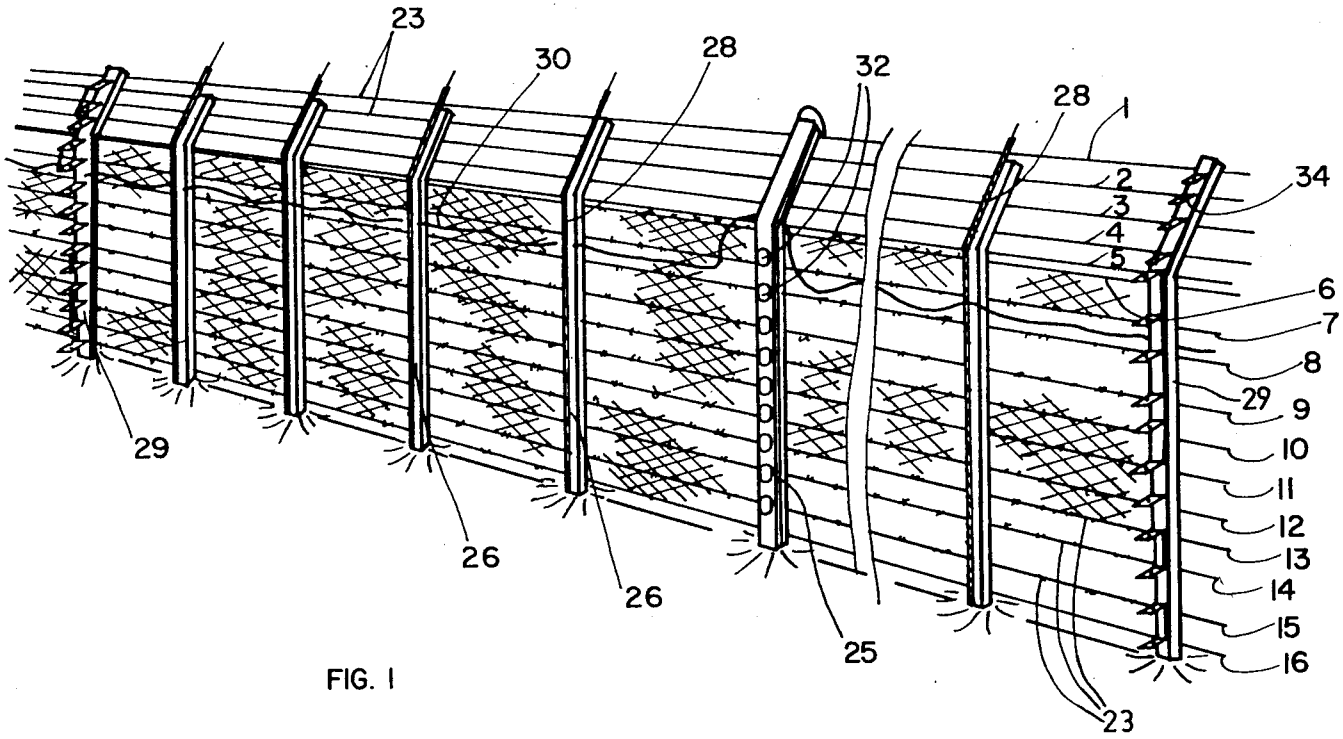
FIG. 1 is a pictorial illustration of a taut wire fence system constructed and operative in accordance with a preferred embodiment of the present invention.

Reference is now made to FIG. 1 where there is shown a portion of a taut wire intrusion detection fence system comprising taut wires 23 strung in generally parallel orientation and mounted between first and second anchoring posts 29 and a sensor post 25 located therebetween. Intermediate the anchoring posts 29 and the sensor post 25 are a plurality of intermediate posts 26 associated with taut wire space maintainers 28 and whose particular structure is outside the scope of the present invention. A control wire cable 30 interconnects the sensor posts 25 to a central command and control installation (not shown) which is beyond the scope of the present invention.

Mounted on sensor posts 25 are a plurality of taut wire displacement sensors 32, shown in phantom, which sense the displacement of the taut wires 23 due to attempted intrusion through the fence, as by cutting a wire or pulling wires apart.

At the anchor posts 29, the taut wires are principally supported thereon on frangible strips 34 which are breakable in response to the application of transverse forces thereon. In contrast to the prior art wherein each length of taut wire is separately attached at both opposite ends to such frangible strips 34, in accordance with a preferred embodiment of the invention, a plurality of lengths of taut wire are interconnected, such that a change in tension of one length, as by pulling or cutting thereof causes a corresponding change in tension of another length. Since the different lengths may be and are preferably connected to different sensors, a single such distrubance or attempted neutralization of the system activates a plurality of sensors.

It may be appreciated that the arrangement of the present invention is particularly useful in overcoming attempted neutralization of the system by isolating a single sensor by clamping of the wires attached thereto prior to cutting those wires to achieve penetration of the fence.

Figure 2:
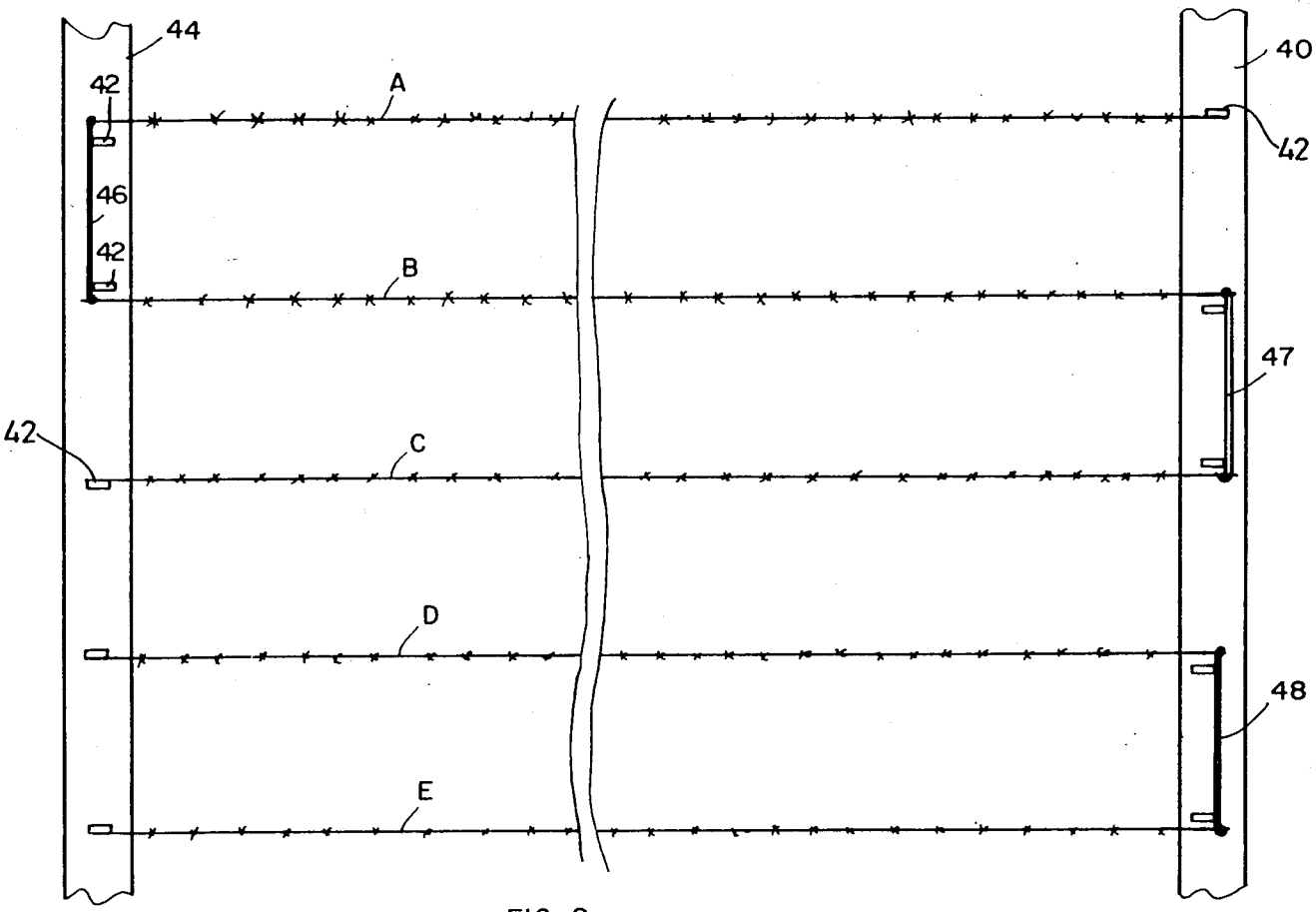
FIG. 2 is a detailed, partially cut away, pictorial illustration of the system of FIG. 1 illustrating the interconnections of the lengths of taut wire in accordance with one embodiment of the invention.
Figure 3:
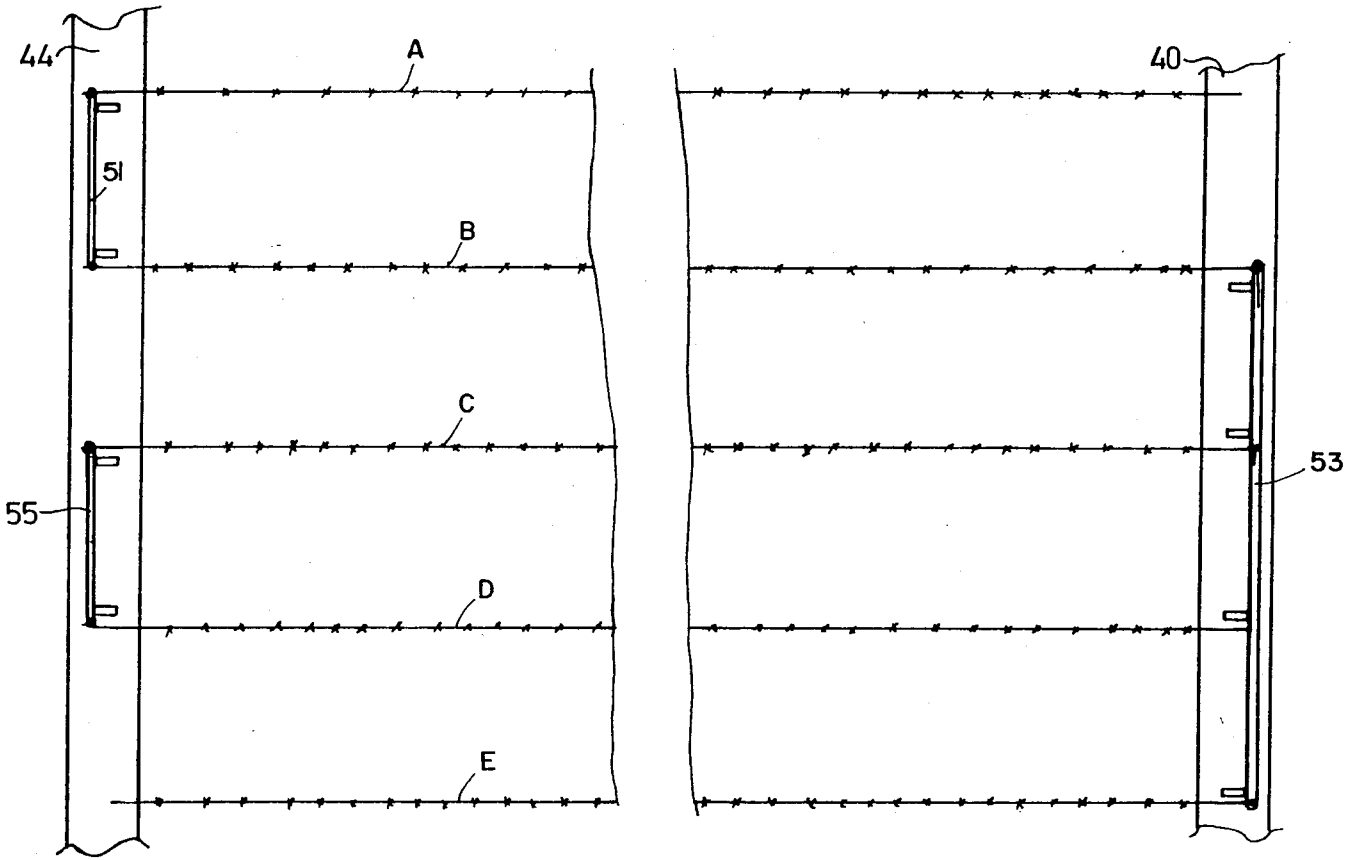
FIG. 3 is a detailed, partially cut away, pictorial illustration of the system of FIG. 1 illustrating the interconnections of the lengths of taut wire in accordance with another embodiment of the invention.
Figure 4:
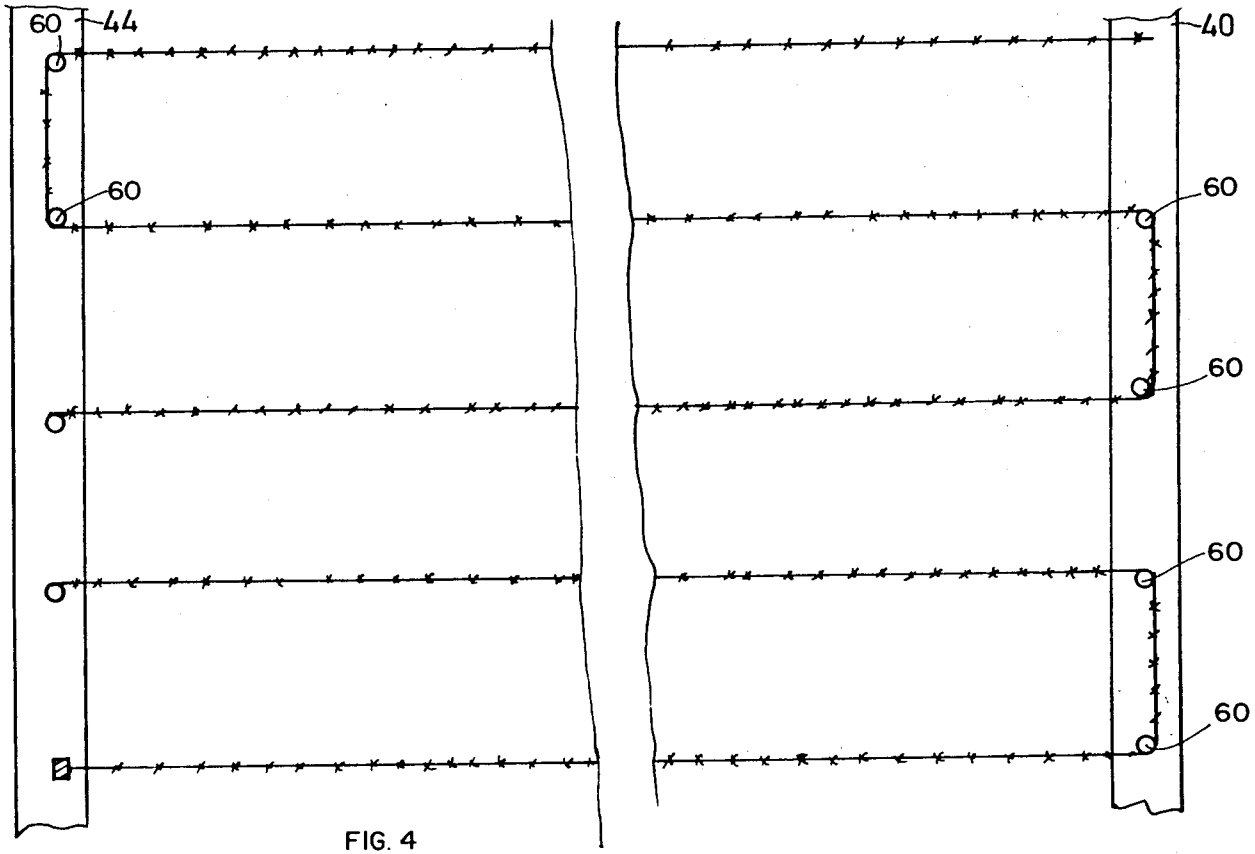
FIG. 4 is a detailed, partially cut away, pictorial illustration of the system of FIG. 1 illustrating the interconnections of the lengths of taut wire in accordance with still another embodiment of the invention.

In FIG. 1, some of the parallel arranged lengths of taut wires. Details of these interconnections are illustrated in FIGS. 2–4, it being appreciated that any suitable combination of taut wire lengths may be interconnected by any suitable type of interconnection which permits the change in tension along one length to be sensible in another length. It is noted that not all of the lengths need be interconnected and that the interconnected lengths may be adjacent or non-adjacent or any combination of both. Any number of interconnected lengths may be provided in a given series and any desired number of series of interconnected lengths may be provided in a given portion of a fence.

Reference is now made to FIG. 2 which illustrates the interconnection of taut wire lengths in enhanced detail. In this illustration the connections of the taut wire lengths at the two anchor posts 29 are illustrated and, for simplicity, the connections at intermediate posts 26 and at sensor post 25 are not shown. It is seen that length A of taut wire is anchored at anchor post 40 onto a frangible support strip 42 or other suitable support. At its opposite end, at anchor post 44, length A is attached to an interconnection rod 46, which is in turn connected to a length B of taut wire and via another interconnection rod 47 to a length C which is anchored via a support strip 42 onto anchor post 44.

Interconnection rods 46 and 47 are supported by support strips 42 but not attached thereto, such that pulling or cuttng either of lengths A or B causes a corresponding displacement in the other length, which displacement is sensed by the displacement sensor (not shown), attached thereto, In the illustrated embodiment, the interconnection rods slides or pivots relative to strips 42 for transferring displacement from one length to the other.

In the illustrated embodiment, lengths D and E are also interconnected by an interconnection rod 48 similar in construction and operation to rods 46 and 47.

In the embodiment of FIG. 2, the interconnected lengths of taut wire are disposed adjacent to each other. In FIG. 3, there is illustrated an alternative embodiment of the invention in which lengths of taut wire, A, B and E are interconnected by rods 51 and 53 and lengths C and D are interconnected by rod 55. Here it is seen that the interconnected lengths of taut wire need not be adjacent to each other. In this way patterns of interconnected lengths of taut wire may be provided which may it difficult for a potential intruder to neutralize by clamping of adjacent wires.

In the embodiments described hereinabove, the individual lengths of taut wire have been interconnected by connecting members, such as rods. It is also possible to construct a taut wire fence system in accordance with the present invention wherein a few lengths of taut wire are in fact continuous and thus do not require interconnection by interconnecting members such as rods. One such embodiment is shown in FIG. 4, wherein rollers 60 are provided on the anchor posts 40 and 44 for supporting the taut wires as illustrated. These rollers permit sliding motion of the taut wires relative thereto such that a change in tension on one of the wire lengths is transferred to the other lengths connected thereto for actuation of sensors associated therewith. It is appreciated that these rollers may simply be members with smooth surfaces which permit the required sliding motion, or alternatively may be bearing elements, or elements for mounting otherwise, as desired.

It will be appreciated by persons skilled in the art that the present invention is not limited by what has been particularly shown and described hereinabove. Rather the scope of the present invention is defined only by the claims which follow.

I claim:

1. A taut wire fence system comprising:

a plurality of lengths of taut non-electrified wire strung in generally parallel orientation and mounted between a pair of anchoring posts, a least two of said plurality of lengths forming a set being interconnected mechanically on at least one anchoring post of said pair of anchoring posts, with multiple interconnected sets being provided, and sensor means mounted on a sensor post, said sensor means comprising a plurality of sensors each being adapted to interact with a different one of said lengths in said multiple interconnected sets so as to provide an indication of changes in tension therein, said mechanical interconnection in each of said multiple interconnected sets enabling a single disturbance producing a change in tension in one of said lengths to cause a corresponding change in tension in at least another one of said lengths, said changes in tension mechanically actuating a plurality of said sensors to provide said indication of changes in tension in at least two of said lengths of taut wire.

2. A system according to claim 1 and wherein at least two of said interconnected lengths are adjacent to each other.

3. A system according to claim 1 and wherein at least two of said interconnected lengths are non-adjacent to each other.

4. A system according to claim 1 and wherein said plurality comprises at least three lengths.

5. A system according to claim 2 and also comprising interconnection means for connecting said interconnected lengths together.

6. A system according to claim 3 and also comprising interconnection means for connecting said interconnected lengths together.

7. A system according to claim 1 and also comprising interconnection means for connecting said interconnected lengths together.

8. A system according to claim 1 and wherein said taut wire comprising said plurality of interconnected lengths comprises a unitary continuous length of taut wire.

9. A system according to claim 5 and also comprising mounting means for slidably mounting said taut wire onto said anchoring posts.

* * * * *